United States Patent [19]

McLennan et al.

[11] Patent Number: 4,852,875

[45] Date of Patent: Aug. 1, 1989

[54] RACQUET SWING TRAINING APPARATUS

[76] Inventors: Jim McLennan, 430 San Luis Ave., Los Altos, Calif. 94022; Richard Davis, 4037 El Camino Way, Palo Alto, Calif. 94306; Donald Kerr, P.O. Box 386, Waveland, Miss. 39576

[21] Appl. No.: 133,374

[22] Filed: Dec. 15, 1987

[51] Int. Cl.[4] ..... A63B 61/00; A63B 69/38

[52] U.S. Cl. ..... 273/29 A; 273/26 B; 273/186 A; 73/517 R; 324/162; 324/179; 377/23

[58] Field of Search ..... 273/29 R, 29 A, 26 B, 273/148 B, 186 A; 73/517 R, 517 A; 324/162, 179; 377/23

[56] References Cited

U.S. PATENT DOCUMENTS 4,489,303 12/1984 Martin ..... 273/148 B
4,515,368 5/1985 Petitjean ..... 273/186 A
4,759,219 7/1988 Cobb et al. ..... 73/493

*Primary Examiner*—Maryann Lastova
*Attorney, Agent, or Firm*—Pravel, Gambrell, Hewitt, Kimball & Krieger

[57] ABSTRACT

A swing training apparatus for use with a hand held sports implement having a head and a handle with a longitudinal axis extending between the head and handle includes a housing that is mounted to the implement at a position adjacent the head. A sleeve carried by the housing defines a bore with a bore axis generally parallel to the implement longitudinal axis. A slug is carried by the sleeve in the bore and has a metallic portion defining a first electrical contact. A spring is used to bias the slug into a position spaced away from the implement head. A second electrical contact is positioned to engage the first contact when a preset centripetal force urges the slug to travel toward the implement head when the implement is swung with sufficient force. An indicator emits an audible signal and emits the signal as the implements reaches the preset centrifugal force threshhold. Sufficient centripetal force thus moves the slug and causes it to engage the first and second contacts closing a circuit to the indicator. The apparatus can be adjusted to measure different centripeal threshholds. The performer receives audible information at the moment of peak centripeal force. Ideally, that moment should occur at impact. The apparatus works as a training device to aid the performer improve his/her timing.

12 Claims, 3 Drawing Sheets

RACQUET SWING TRAINING APPARATUS

BACKGROUND OF THE INVENTION

1. Field of the Invention

The present invention relates to sports such as racquet sports and more particularly to training devices for helping players analyze their swing using centripetal force generated during the swing to generate an audible or visible signal that is fed back to the player when a desired velocity threshold is reached or exceeded.

There are a number of different sports which use hand held implements such as racquets, baseball bats, cricket bats, golf clubs and the like, to hit an object, typically a round ball. Tennis is perhaps the most popular of all racquet sports, however, arguably the most difficult to master. The proper stroking of a racquet to hit or serve a tennis ball requires not only a proper position of the racquet, but also a swing of sufficient and well timed force, such that the moment of greatest force occur at impact, rather than before or after impact.

2. General Background

A number of devices have been patented which have attempted to solve the problem of indicating in some way to the user of a racquet or other hand held sport implement, the speed of the swing. These prior patented devices have attempted to indicate speed, sometimes through a signal so that the user can improve his or her swing and thus hopefully improve his or her game. An example of a recent patent entitled "Swing Speed Analyzer" is U.S. Pat. No. 4,377,125 issued to Leonard Westfall. The Westfall patent provides a training or practice device especially designed for use on an athletic club type equipment such as a golf club, tennis racquet, baseball bat or the like which is swung to strike a game ball during normal game ball use and which device is releasably attached to the club, racquet, or bat and operable to provide an audible and visual indication when the swing of the club type equipment has the optimum velocity and power for striking the game ball. The device is manually resetable after each swing of the equipment, for subsequent and repeatable use whereby the user by practice may repeatedly obtain the optimum velocity and power of each swing of the equipment. The device uses a sliding plunger held in an initial position by a transversely positioned screw that presses against a snap. The device produces an audible "click" when two surfaces come quickly together during the swing. A tuning fork can provide for amplification of the sound of impact of the two striking surfaces.

U.S. Pat. No. 4,094,504 issued to Kenneth Barasch entitled "Signalling Device To Be Used With A Sport Implement For Detecting And Indicating The Proper Or Improper Use Thereof" relates to a signalling device which can be connected to a sport implement so as to audibly indicate the fact that the user is or is not using the implement in the properly intended manner. The device includes an air actuable signalling device that includes a plurality of reeds, each of the reeds having a longitudinal axis, for emitting an audible signal when air passes through the device in a predetermined manner. Some of the reeds are mounted on the tennis racquet in a first direction so as to indicate a proper forehand stroke of the tennis racquet and the other ones of the reed members are mounted on the tennis racquet in a direction opposite from the first direction so as to indicate a proper backhand stroke of the tennis racquet.

Another tennis training device that produces an audible signal is disclosed in the Conrey U.S. Pat. No. 4,101,132 entitled "Electronic Athletic Equipment." The Conrey device provides a tennis racquet or any other similar athletic instrument for striking a movable ball or other playing element and includes electronic sensors for providing an audible or audio visual indication of the location on the racquet or instrument at which contact is made with the ball or other playing element. Various devices for sensing the location of the contact are disclosed.

A golf swing practice club is the subject of U.S. Pat. No. 3,575,419 issued to Wallace E. Davis. The Davis patent provides a golf swing practice club with a linear shaft having a handle at one end and a weighed body at the other end. The body provides an axial bore with a spring biased plunger slidably mounted therein. The plunger has an annular groove therein for removably receiving a spring-biased ball detent for yieldingly holding the plunger in its initial or starting position. An anvil screw closes the outer end of the axial bore and a swinging of the club at a certain speed in a golf swing will cause the plunger to move along the bore by centrifugal force and to strike the anvil screw with a loud click. The follow through portion of the golf swing will slow the speed of the club and permit the plunger spring to reset the plunger with a less loud click and the ball detent will yieldingly hold the plunger in its reset position ready for the next golf swing.

U.S. Pat. No. 1,136,546 issued to Joseph Connelly discloses a swingable practice game implement with a sliding weight. A shaft has a head in which the sliding weight is mounted for limited axial movement. A spring pressed ball detent is carried by the weight and received in short keeper grooves for spacing the weight a predetermined distance from a stop collar and another set of spring pressed ball detents are carried by the weight and are receivable in a second keeper groove for spacing the weight a less distance from the stop collar. The weight has a projection that extends through an opening in the stop collar and this projection is manually depressed after each swing of the device by the user to reset the sliding weight.

An early patent No. issued to A. M. Maroth, U.S. Pat. No. 2,780,098, is entitled "Indicating Cage Responsive To Circular Or Angular Velocity." The Maroth U.S. Pat. No. 2,780,098 provides an indicating gauge responsive to velocity along an arcuate path and includes a guide that is adapted to be radially disposed with respect to the arcuate path. In response to swinging of the racquet, bat, golf club, or the like, an indicating member is driven against the force of a return spring. The indicating member cooperates with a calibrated scale to indicate the circular or angular velocity of the swing or the speed or probable distance traveled by a struck ball or other object and the indicating member is retained in the position thereof corresponding to the maximum displacement of the mass during the swing until the indicating member is released for return to its original zero indicating position.

Several other patents are directed generally to the problem of signaling the user of a tennis racquet including, for example, the Bates U.S. Pat. No. 4,063,730 entitled "Tennis Racquet Swing Training Device," and the Richards U.S. Pat. No. 4,535,986 entitled "Inclination Signalling Device On A Tennis Racquet."

These devices as above-described suffer in that they do not provide an indicator of a desired threshold velocity value so that a player knows when peak force occurs and thereby know if peak force occurred at contact which is desirable and indicates good timing. It is important in developing proper tennis form that peak force of the swing coincide with ball contact. Thus, the present invention solves this prior art problem by providing an audible signal at peak force of the swing and allows the performer to practice placing peak force at the moment of contact.

SUMMARY OF THE PRESENT INVENTION

The present invention provides a tennis racquet swing training apparatus for use with hand held sport implements such as tennis racquets, baseball bats, or the like, having a head and handle connected by a shaft with a longitudinal axis extending between the handle and the head and along the shaft. For purposes of this application, such implement will be hereafter referred to as a tennis racquet. The apparatus includes a housing and a means for attaching the housing to the racquet at a position adjacent the head. A sleeve is carried by the housing and defines a bore with a bore axis generally parallel to the racquet longitudinal axis. A slug is carried by the sleeve and has a metallic portion defining a first electrical contact. A spring biases the slug into a first position which is spaced away from the electrical contact. A second electrical contact is positioned to engage the first contact when a preset centripetal force urges the slug to travel toward the racquet head when the racquet head is swung with sufficient force. An audible indicator emits an audible signal as the racquet is swung and the slug moves to engage the first and second contacts. In the preferred embodiment, the slug is a metallic member that is affixed directly to the spring means and the spring means is preferably an elongated coil spring.

In the preferred embodiment, the sleeve is a non-metallic tube. In one embodiment, the slug is magnetized, and the indicator includes a hall effect sensor.

The indicator means can comprise in part a transistor which is triggered in response to travel of a magnetized slug to a position adjacent the transistor.

In the preferred embodiment, the indicator includes a piezoelectric transducer.

In the preferred embodiment, the indicator includes in part a magnetic switch.

In the preferred embodiment, there is further provided means for adjusting the amount of force needed to activate the audible indicator means. In the preferred embodiment, the adjusting means includes an adjustable screw for changing the position of the electrical contacts with respect to each other, or selectively a stronger/weaker spring or adjusting threshold trigger level of the trigger transistor.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

FIGS. 1–5 illustrate the preferred embodiment of the apparatus of the present invention designated generally by the numeral 10.

Figure 1:
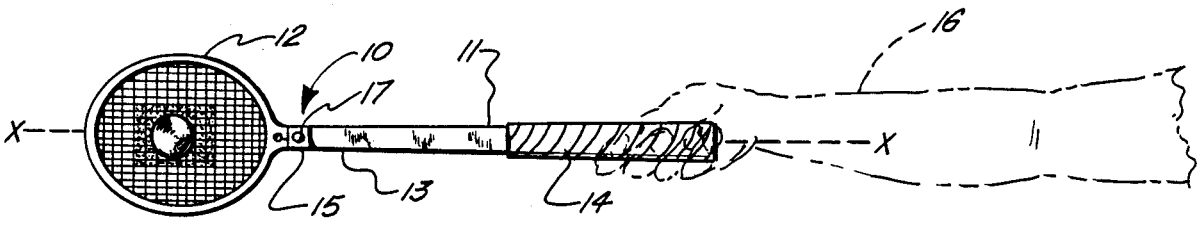
FIG. 1 is a partial side view of the preferred embodiment of the apparatus of the present invention illustrating its use with a tennis racquet as held by a user.

The racquet swing training device 10 can be used, for example, on a conventional tennis racquet 11 having an elongated shaft 13 with a head 12 and handle 14 end portions being attached to the end portions of the racquet. The racquet could include elongated shaft 13 with the portion of shaft 13 adjacent head 12 being a throat area of the shaft. In FIG. 1, 16 designated in phantom lines is the tennis player's arm.

Figure 4:
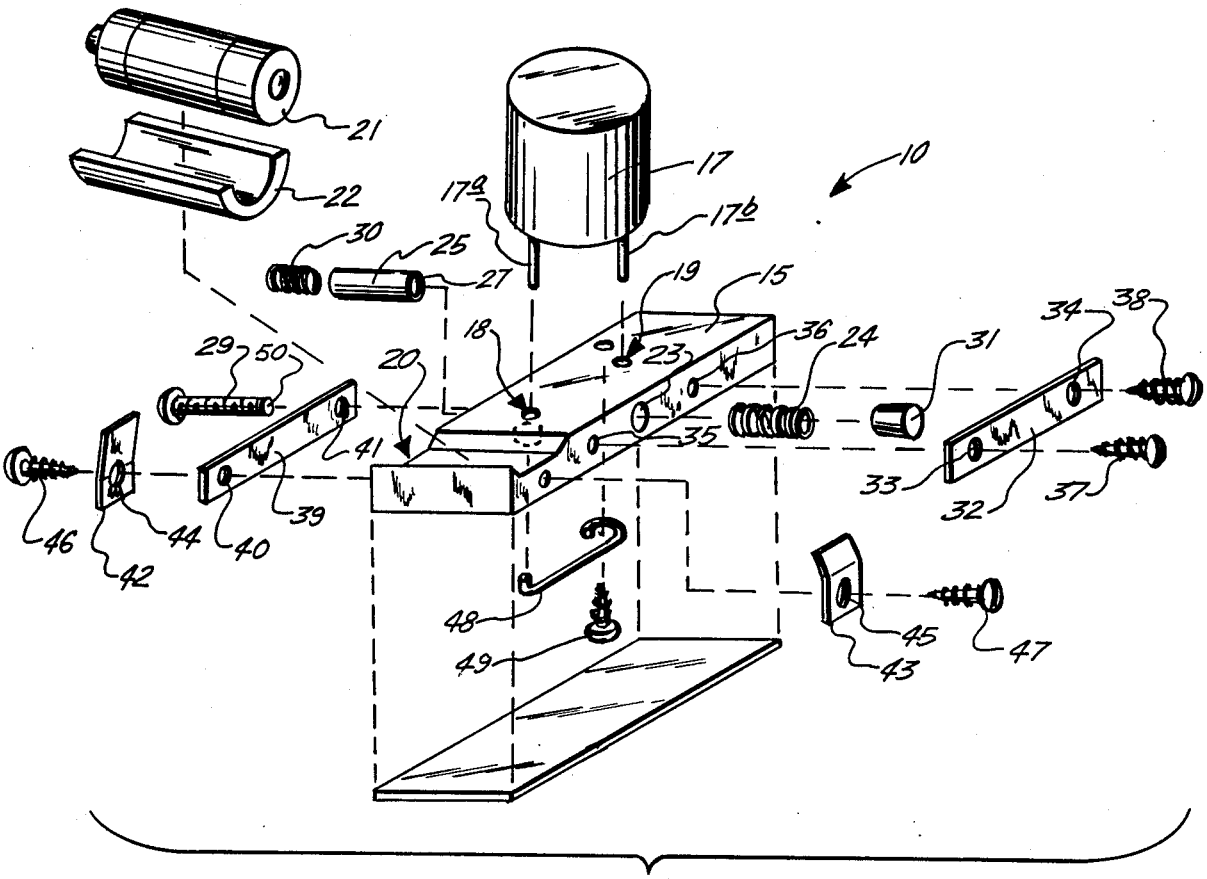
FIG. 4 is an exploded perspective view of the preferred embodiment of the apparatus of the present invention.

FIG. 4 shows an exploded view of apparatus 10 which includes an insulative housing 15 of plastic, for example, upon which is mounted an audible indicator such as, for example, a piezoelectric buzzer 17 having contacts 17*a*, 17*b* (FIG. 4). Housing 15 includes a pair of spaced apart openings 18, 19 which are receptive of contacts 17*a*, 17*b* (FIG. 4). A recess 20 formed on the upper surface of housing 15 accommodates battery 21 which can be attached thereto, for example, using half sleeve 22 which can be, for example, coated with adhesive on both sides such as, for example, a foam rubber member having double sided adhesive tape type surfaces.

Housing 15 includes a cylindrical bore 23 which is positioned during use parallel with the longitudinal axis of racquet 1 which is designated generally by the dotted line X—X in FIG. 1. Mounted within bore 23 is a spring 24. A cylindrical sleeve 25 can be used to line bore 23 if, for example, the body 15 is of a plastic material such as injection molded plastic or machinable plastic. Sleeve end plate 26 closes one end portion of sleeve 25 terminating the end portion of sleeve bore 27. A threaded opening 28 is formed through end plate 26 which threadably accommodates adjustment screw 29. Coil spring 30 secures the position of adjustment screw 29 in threaded opening 28 so that during use the screw will not move after an adjustment is made.

Figure 2:
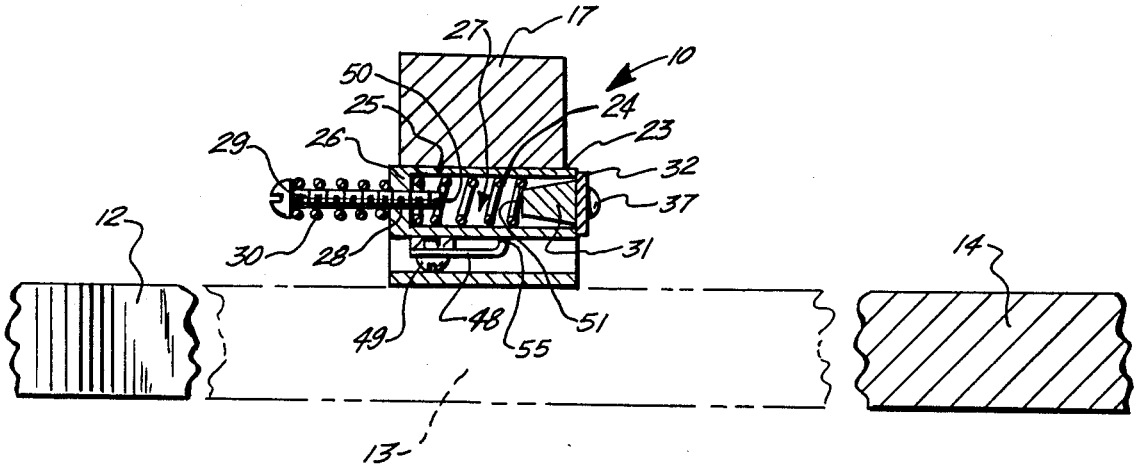
FIG. 2 is a side sectional view of the preferred embodiment of the apparatus of the present invention.
Figure 3:
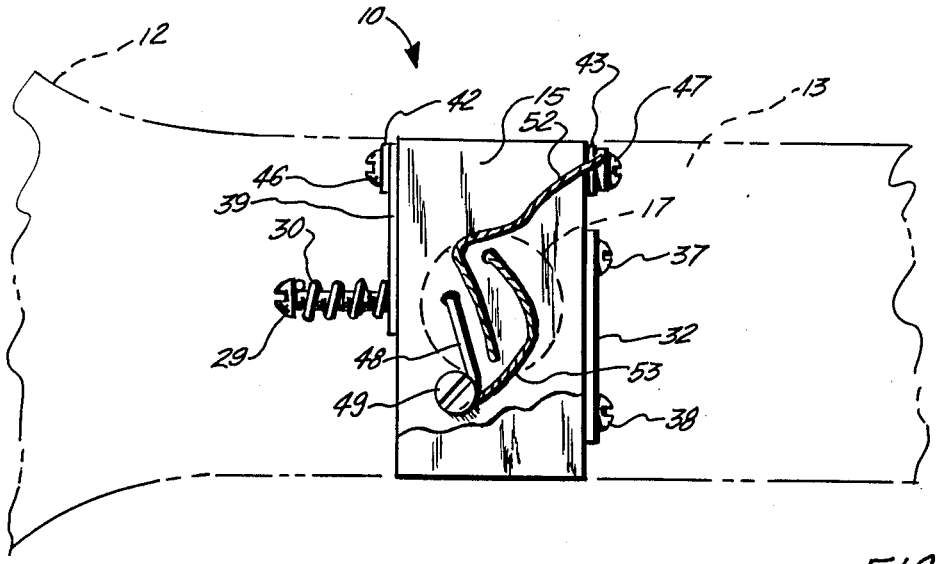
FIG. 3 is a top fragmentary view of the preferred embodiment of the apparatus of the present invention.

A frustoconical and preferably steel inertial slug element 31 is mounted for travel within sleeve 25 and more particularly occupying sleeve bore 27 as shown in FIG. 2. Cover plate 32 secures slug element 31 within bore 27. Plate 32 includes spaced apart openings 33, 34 which align with the openings 35, 36 in housing 15. Assembly screws 37, 38 can be used to assemble the plate 32 to the housing 15 as best seen in FIGS. 3 and 4. A bridge plate 39 provides an electrical bridge between adjustment screw 29 and contact 42. A pair of spaced apart openings 40, 41 are formed in bridge plate 39. Spaced apart battery contacts 42, 43 are affixed to housing 15 at openings 44, 45 in housing 15 using assembly screws 46, 47. Thus when battery 21 is in position, an electrical contact can be made between the battery and the adjustment screw 29. During operation, the slug 31 will travel through the bore 27 of sleeve 25 overcoming the spring 24 when sufficient centripetal force is developed by the swinging motion of the tennis player 16. A contact arm 48 extends between assembly screw 49 and one of the buzzer electrodes 17*a*, 17*b*. Adjustment screw 29 includes an end portion 50 defining a stop against which the slug surface 51 can abut. The contact element 48 has end portions including one end portion receptive of assembly screw 49 and another end portion that defines a contact at 55 between sleeve 25 and member 48. Electrical supply lines 52, 53 are used to complete the circuit between the contact member 48 and one of the buzzer terminals 17*a*, 17*b* while the line 52 forms a connection between the other remaining contacts 17*a*, 17*b* and battery terminal 43. Thus, a circuit is completed then sufficient centrifugal force urges slug 31 to screw 29 end portion 50 overcoming spring 24 to complete a circuit.

Figure 5:
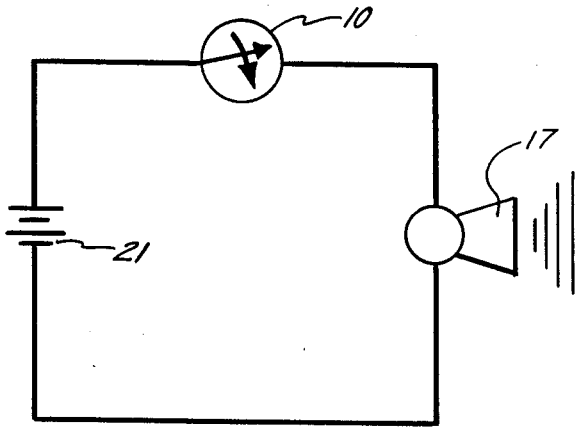
FIG. 5 is a simple schematic illustration of the preferred embodiment of the apparatus of the present invention.

In FIG. 5, the simple schematic shows as generally indicated by the numeral 10 the apparatus which is shown as a centrifugal switch in the circuit that also includes the buzzer 17 and the battery 21.

Figure 6:
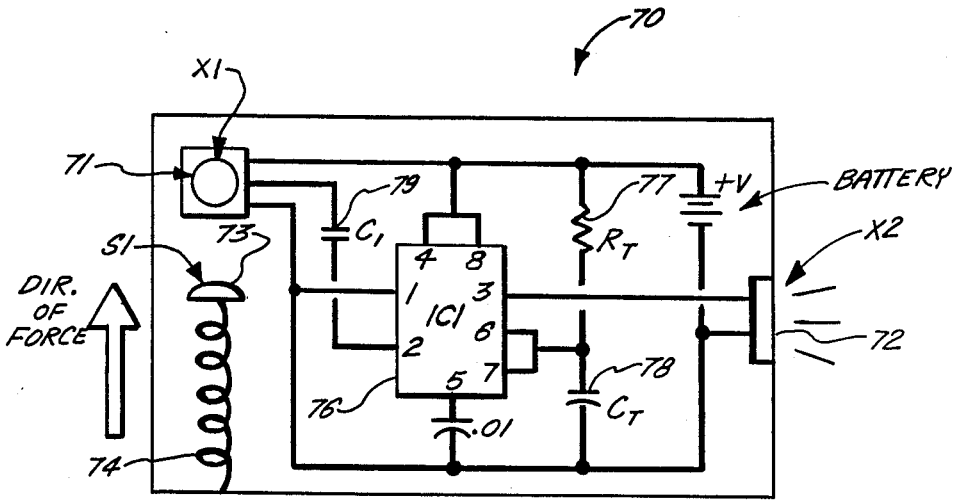
FIG. 6 is a schematic view of a second circuit for the centrifugal switch portion of the apparatus of the present invention.
Figure 7:
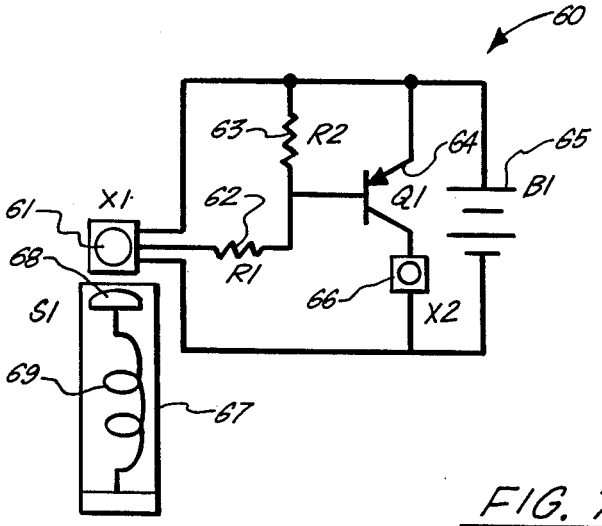
FIG. 7 is a schematic circuit diagram of a third circuit for the centrifugal switch portion of the apparatus of the present invention.

FIGS. 6 and 7 show additional embodiments of centripetal switch circuits that can be used instead of the preferred embodiment of the present invention. The embodiment of FIG. 6 is designated generally by the numeral 70. In FIG. 6, 71 is a Hall effect transducer, and wherein 72 indicates an audio transducer, 73 a ferro magnetic slug with a spring 74 attached thereto. A Timer IC 76 such as NE555 has pin labels as follows:

1=ground
2=trigger input
3=output
4=reset
5=control voltage
6=threshold
7=discharge
8=positive volts The remaining elements of circuit 70 include resistor 77, capacitor 78, and capacitor 79. The relationship RT/CT is chosen for the length of beep or audible signal desired. In the embodiment of FIG. 7 designated generally by the numeral 60, the hall effect switch 61 is shown as including a ferro magnetic slug 68 attached to spring 69 mounted within non-metallic sleeve 67. The remaining elements of circuit 60 include resistors 62, 63, transistor 64, battery 65, and audio transducer 66.

The foregoing description of the invention is illustrative and explanatory thereof, and various changes in the size, shape and materials, as well as in the details of the illustrated construction may be made without departing from the spirit of the invention.

What is claimed as invention is:

1. A swing training apparatus for use with a hand held sports implement having a head and a handle with a longitudinal axis extending between the handle and the head, comprising:

a. a support;
b. means for attaching the support to the implement at a position adjacent to the head;
c. the support having a bore generally parallel to the longitudinal axis of the implement when the support is attached thereto in an operating position;
d. a magnetic slug shiftably mounted in the bore;
e. means for biasing the slug in one direction to cause it to return to an initial rest position after the slug moves in response to force applied thereto during a swinging of the implement;
f. magnetic sensor means normally spaced from the magnetic slug for producing an electrical output signal proportional to the proximity of the magnetic slug to the sensor means; and
g. transducer means for generating a measured signal as the implement is swung and when the magnetic slug is moved to a position that approaches the linear magnetic sensor means, the signal changing in value depending upon the proximity of the slug to the sensor means.

2. The apparatus of claim 1, wherein the slug is affixed to directly the supporting and biasing means.

3. The apparatus of claim 1, wherein a sleeve defines said bore, the sleeve being a non-metallic tube.

4. The apparatus of claim 3, wherein the slug is magnetized.

5. The apparatus of claim 4, wherein the signal emitting means includes a Hall Effect Sensor.

6. The apparatus of claim 5, wherein the signal emitting means includes a transistor triggered in response to the travel of the magnetized slug to a position adjacent the Hall Effect Sensor.

7. The apparatus of claim 6, wherein the signal emitting means includes a piezoelectric transducer.

8. The apparatus of claim 1, wherein the signal emitting means includes a magnetic switch.

9. The apparatus of claim 1 further comprising means for adjusting the amount of force needed to activate the signal emitting means.

10. The apparatus of claim 9, wherein the adjusting means includes means for changing the position of the second electrical contact.

11. The apparatus of claim 1, wherein the generating means generates a value that is proportional to the force applied to the implement during a swinging of the implement.

12. A swing training apparatus for use with a hand held sports implement having a head and a handle with a longitudinal axis extending between the handle and the head, comprising:

a. a support;
b. means for attaching the support to the implement at a position adjacent to the head;
c. the support having a bore generally parallel to the longitudinal axis of the implement when the support is attached thereto in an operating position;
d. a magnetic slug shiftably mounted in the bore;
e. means for biasing the slug in one direction to cause it to return to an initial rest position after the slug moves in response to force applied thereto during a swinging of the implement;
f. magnetic responsive switch means including a switch body normally spaced from the magnetic slug for producing an electrical output signal as the magnetic slug approaches the switch body so that a signal is produced at a predetermined adjustable position prior to a contact of the magnetic slug and the switch body;
g. means for generating a signal as the implement is swung and when the magnetic slug is moved to a position that approaches but before contacting the switch body.

* * * * *